US011517045B2

(12) United States Patent
Buehler

(10) Patent No.: US 11,517,045 B2
(45) Date of Patent: Dec. 6, 2022

(54) CARTRIDGE COMPRISING A COUPLING ELEMENT FOR USE IN AN AEROSOL-GENERATING SYSTEM

(71) Applicant: Philip Morris Products S.A., Neuchatel (CH)

(72) Inventor: Frederic Ulysse Buehler, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 404 days.

(21) Appl. No.: 16/093,388

(22) PCT Filed: Apr. 26, 2017

(86) PCT No.: PCT/EP2017/059974
§ 371 (c)(1),
(2) Date: Oct. 12, 2018

(87) PCT Pub. No.: WO2017/186811
PCT Pub. Date: Nov. 2, 2017

(65) Prior Publication Data

US 2019/0059445 A1 Feb. 28, 2019

(30) Foreign Application Priority Data

Apr. 28, 2016 (EP) ..... 16167556

(51) Int. Cl.
*A24F 40/30* (2020.01)
*A24F 40/42* (2020.01)
(Continued)

(52) U.S. Cl.
CPC ..... *A24F 40/30* (2020.01); *A24F 40/10* (2020.01); *A24F 40/42* (2020.01); *A24F 40/20* (2020.01)

(58) Field of Classification Search
CPC ..... A24F 40/30; A24F 40/42
(Continued)

(56) References Cited

U.S. PATENT DOCUMENTS 3,765,426 A * 10/1973 Halaby ..... A24F 5/00 131/176
8,813,759 B1 * 8/2014 Horian ..... A61M 15/06 131/273
(Continued)

FOREIGN PATENT DOCUMENTS

CN 101557728 A 10/2009
CN 101677634 A 3/2010
(Continued)

OTHER PUBLICATIONS

Combined Chinese Office Action and Search Report dated Nov. 30, 2020 in Patent Application No. 201780024538.8 (with English language translation), 22 pages.
(Continued)

*Primary Examiner* — Kelly M Gambetta
*Assistant Examiner* — Russell E Sparks
(74) *Attorney, Agent, or Firm* — Oblon, McClelland, Maier & Neustadt, L.L.P.

(57) ABSTRACT

A cartridge for an aerosol-generating system is provided, including a first sealed container including a nicotine source comprising a first carrier material impregnated with between about 1 milligram and about 50 milligrams of nicotine; a second sealed container including an acid source; and a coupling element disposed between the first sealed container and the second sealed container, wherein the first sealed container, the second sealed container, and the coupling element are separate components that are connected together to form the cartridge, and wherein the coupling element is directly connected to both the first sealed container and the
(Continued)

second sealed container so as to form a substantially rigid connection between the first sealed container and the second sealed container.

15 Claims, 2 Drawing Sheets

(51) Int. Cl.
*A24F 40/10* (2020.01)
*A24F 40/20* (2020.01)

(58) Field of Classification Search
USPC ..... 131/329
See application file for complete search history.

(56) References Cited

U.S. PATENT DOCUMENTS

| | | | | |
|---|---|---|---|---|
| 9,549,573 | B2 * | 1/2017 | Monsees | H05B 1/0244 |
| 11,197,498 | B2 * | 12/2021 | Waller | A24B 15/167 |
| 2009/0260641 | A1 | 10/2009 | Monsees et al. | |
| 2012/0255567 | A1 | 10/2012 | Rose et al. | |
| 2014/0366898 | A1 | 12/2014 | Monsees et al. | |
| 2016/0227839 | A1 * | 8/2016 | Zuber | A24F 47/004 |
| 2017/0095002 | A1 | 4/2017 | Silvestrini | |

FOREIGN PATENT DOCUMENTS

| | | | | |
|---|---|---|---|---|
| CN | 101986779 | A | 3/2011 | |
| CN | 102379458 | A | 3/2012 | |
| CN | 103190708 | A | 7/2013 | |
| CN | 103202537 | A | 7/2013 | |
| CN | 103393222 | A | 11/2013 | |
| CN | 104824850 | A | 8/2015 | |
| CN | 204519372 | U | 8/2015 | |
| CN | 104994757 | A | 10/2015 | |
| CN | 105407748 | A | 3/2016 | |
| CN | 105491899 | A | 4/2016 | |
| EP | 2 706 877 | | 3/2014 | |
| KR | 10-2015-0139683 | | 11/2015 | |
| RU | 94 815 | U1 | 6/2010 | |
| WO | WO 2007/143993 | A2 | 12/2007 | |
| WO | WO 2008/121610 | A1 | 10/2008 | |
| WO | WO 2012/156708 | A1 | 11/2012 | |
| WO | WO 2014/140087 | A1 | 9/2014 | |
| WO | WO 2015/040180 | A2 | 3/2015 | |
| WO | WO-2015040180 | A2 * | 3/2015 | A24B 15/167 |
| WO | WO 2015/155289 | A1 | 10/2015 | |
| WO | WO 2015/197502 | A1 | 12/2015 | |
| WO | WO 2015/197627 | A1 | 12/2015 | |
| WO | WO 2016/124780 | A1 | 8/2016 | |
| WO | WO 2017/029149 | A1 | 2/2017 | |

OTHER PUBLICATIONS

Maciej L. Goniewicz, "Electronic Cigarettes are a Source of Thirdhand Exposure to Nicotine," Nicotine & Tobacco Research, vol. 17, No. 2, 2015, pp. 256-258.

Hu Bin, et al., "Development of New Tobacco Products and Impact on the Tobacco Industry," Global Market Information Guide, No. 15, Jun. 8, 2015, pp. 34-35.

International Search Report and Written Opinion dated Sep. 18, 2017 in PCT/EP2017/059974, filed Apr. 26, 2017.

Office Action dated May 27, 2020 in corresponding Russian Patent Application No. 2018141598/03(069320) (with English Translation), 10 pages.

Extended European Search Report dated Sep. 30, 2016 in Patent Application No. 16167556.6.

Combined Chinese Office Action and Search Report dated Jul. 7, 2021 in Chinese Patent Application No. 201780024538.8 (with English translation), 21 pages.

Office Action dated Sep. 7, 2020 in corresponding Russian Patent Application No. 2018141598 (with English Translation), 13 pages.

South Korean Office Action dated Feb. 3, 2022 in corresponding South Korean Patent Application No. 2018-7030263 (with English translation), 11 pages.

Chinese Notice of Allowance and Search Report dated Jan. 26, 2022 corresponding Chinese Patent Application No. 201780024538.8 (with English translation), 7 pages.

* cited by examiner

CARTRIDGE COMPRISING A COUPLING ELEMENT FOR USE IN AN AEROSOL-GENERATING SYSTEM

The invention relates to a cartridge for use in an aerosol-generating system, an aerosol-generating system comprising such a cartridge and a method of manufacturing such a cartridge. In particular, the invention relates to a cartridge comprising a nicotine source and an acid source for use in an aerosol-generating system for the generation of an aerosol comprising nicotine salt particles, an aerosol-generating system comprising such a cartridge and a method of manufacturing such a cartridge.

Devices for delivering nicotine to a user comprising a nicotine source and a volatile delivery enhancing compound source are known. For example, WO 2008/121610 A1 discloses devices in which nicotine and a volatile acid, such as pyruvic acid, are reacted with one another in the gas phase to form an aerosol of nicotine salt particles that is inhaled by the user.

It has been proposed to house the nicotine source and the acid source of devices of the type disclosed in WO 2008/121610 A1 in sealed containers in order to retain sufficient nicotine and acid during storage to generate a desired aerosol upon use of the device. The sealed containers are pierced or otherwise opened when desired to allow reaction between nicotine vapour released from the nicotine source and acid vapour released from the acid source to form an aerosol comprising nicotine salt particles for inhalation by the user.

However, housing the nicotine source and the acid source of devices of the type disclosed in WO 2008/121610 A1 in sealed containers may disadvantageously increase the complexity and cost of manufacturing such aerosol-generating systems and disadvantageously decrease the speed of manufacturing such aerosol-generating systems. In particular, circumscribing separate sealed containers housing the nicotine source and the acid source in a layer of paper or other wrapping material in order to join the sealed containers together during manufacturing of such aerosol-generating systems can be complicated and slow. This method of joining the sealed containers also relies on the strength of the paper or other wrapping material to hold the separate sealed containers in position within the aerosol-generating system. To assist in holding the separate sealed containers in position within the aerosol-generating system, an adhesive may be applied to each of the separate sealed containers housing the nicotine source and the acid source prior to circumscribing the separate sealed containers in the layer of paper or other wrapping material. However, application of an adhesive to each of the separate sealed containers disadvantageously further increases the complexity and cost of manufacturing the aerosol-generating system and disadvantageously further decreases the speed of manufacturing the aerosol-generating system.

It would be desirable to provide a cartridge for use in an aerosol-generating system for generating an aerosol comprising nicotine salt particles that comprises a nicotine source and an acid source housed in separate sealed containers and that can be simply and quickly assembled without the application of an adhesive.

According to the invention there is provided a cartridge for use in an aerosol-generating system, the cartridge comprising: a first sealed container comprising a nicotine source; a second sealed container comprising an acid source; and a coupling element disposed between the first sealed container and the second sealed container, wherein the coupling element is directly connected to both the first sealed container and the second sealed container so as to form a substantially rigid connection between the first sealed container and the second sealed container.

According to the invention there is also provided an aerosol-generating article for use in an aerosol-generating system, the aerosol-generating article comprising: a cartridge according to the invention; and a mouthpiece.

According to the invention there is additionally provided an aerosol-generating system comprising: a cartridge according to the invention or an aerosol-generating article according to the invention; and an aerosol-generating device comprising: a cavity for receiving at least a portion of the cartridge or the aerosol-generating article; and a heater for heating one or both of the first sealed container and the second sealed container of the cartridge.

According to the invention there is further provided a method of manufacturing a cartridge for use in an aerosol-generating system, the method comprising: providing a first sealed container comprising a nicotine source; providing a second sealed container comprising an acid source; providing a coupling element disposed between the first sealed container and the second sealed container; and directly connecting the coupling element to both the first container and the second container so as to form a substantially rigid connection between the first sealed container and the second sealed container.

The first sealed container, the second sealed container and the coupling element are separate components that are connected to one another to form the cartridge.

As used herein with reference to the invention, by "directly connected" is meant that the coupling element is connected to both the first sealed container and the second sealed container without the use of an adhesive or other additional separate component, such as, for example, a wrapper.

As used herein with reference to the invention, by "substantially rigid connection" it is meant that, once directly connected to the first sealed container and the second sealed container, the coupling element substantially prevents movement of the first sealed container and the second sealed container relative to one another within the cartridge. That is, once directly connected to the first sealed container and the second sealed container, the coupling element holds the first sealed container and the second sealed container in a substantially fixed position relative to one another within the cartridge.

Joining the first sealed container to the second sealed container by directly connecting the coupling element to both the first sealed container and the second sealed container advantageously enables cartridges according to the invention to be reliably and consistently assembled without the application of an adhesive. This advantageously reduces the complexity and cost of manufacturing cartridges and aerosol-generating articles according to the invention compared to prior art systems in which sealed containers are joined by circumscribing the sealed containers in an outer wrapper of paper or other wrapping material. It also advantageously increases the speed of manufacturing cartridges and aerosol-generating articles according to the invention compared to prior art systems in which sealed containers are joined by circumscribing the sealed containers in an outer wrapper of paper or other wrapping material.

Joining the first sealed container to the second sealed container by directly connecting the coupling element to both the first container and the second container thereby advantageously reduces the complexity and cost of manufacturing cartridges and aerosol-generating articles according to the invention compared to prior art systems in which sealed containers are joined by circumscribing the sealed containers in an outer wrapper of paper or other wrapping material.

The coupling element may be directly connected to the first sealed container and the second sealed container by any suitable means. Suitable means include, but are not limited to: welding, such as for example, ultrasonic welding, laser welding, hot pressure welding and cold pressure welding; and direct mechanical connections, such as, for example, threaded connections, press-fit connections and snap-fit connections.

It will be appreciated that the suitability of a means for directly connecting the coupling element to the first sealed container and the second sealed container may be dependent upon the materials from which the first sealed container, the second sealed container and the coupling element are made.

The first sealed container may comprise a male mechanical connector and the coupling element may comprise a female mechanical connector that is configured to mate with the male mechanical connector of the first sealed container in order to directly connect the coupling element to the first sealed container. For example, the first sealed container may comprise a male threaded connector and the coupling element may comprise a female threaded connector that is configured to mate with the male threaded connector of the first sealed container in order to directly connect the coupling element to the first sealed container.

The first sealed container may comprise a female mechanical connector and the coupling element may comprise a male mechanical connector that is configured to mate with the female mechanical connector of the first sealed container in order to directly connect the coupling element to the first sealed container. For example, the first sealed container may comprise a female snap-fit connector and the coupling element may comprise a male snap-fit connector that is configured to mate with the female snap-fit connector of the first sealed container in order to directly connect the coupling element to the first sealed container.

The second sealed container may comprise a male mechanical connector and the coupling element may comprise a second mechanical connector that is configured to mate with the male mechanical connector of the second sealed container in order to directly connect the coupling element to the second sealed container. For example, the second sealed container may comprise a male threaded connector and the coupling element may comprise a female threaded connector that is configured to mate with the male threaded connector of the second sealed container in order to directly connect the coupling element to the second sealed container.

The second sealed container may comprise a female mechanical connector and the coupling element may comprise a male mechanical connector that is configured to mate with the female mechanical connector of the second sealed container in order to directly connect the coupling element to the second sealed container. For example, the second sealed container may comprise a female snap-fit connector and the coupling element may comprise a male snap-fit connector that is configured to mate with the female snap-fit connector of the second sealed container in order to directly connect the coupling element to the second sealed container.

The coupling element may be directly connected to the first sealed container and the second sealed container by the same means. For example, the coupling element may be directly connected to both the first sealed container and the second sealed container by welding or the coupling element may be directly connected to both the first sealed container and the second sealed container by a mechanical connection, such as a threaded connection, press-fit connection or snap-fit connection.

The coupling element may be directly connected to the first sealed container and the second sealed container by different means. For example, the coupling element may be directly connected to the first sealed container by welding and directly connected to the second sealed container by a mechanical connection, such as a threaded connection, press-fit connection or snap-fit connection.

Advantageously, the coupling element is directly connected to the first sealed container and the second sealed container by the same means. This may facilitate direct connection of the coupling element to both the first sealed container and the second sealed container.

The first sealed container and the second sealed container of the cartridge may be formed from any suitable material or combination of materials. Suitable materials include, but are not limited to: aluminium; polyether ether ketone (PEEK); polyimides, such as Kapton®; polyethylene terephthalate (PET); polyethylene (PE); high-density polyethylene (HDPE); polypropylene (PP); polystyrene (PS); fluorinated ethylene propylene (FEP); polytetrafluoroethylene (PTFE); polyoxymethylene (POM); epoxy resins; polyurethane resins; vinyl resins; liquid crystal polymers (LCP); and modified LCPs, such as LCPs with graphite or glass fibres.

The coupling element may be made from any suitable material. In some embodiments, the coupling element may be made from the same material as the first sealed container and the second sealed container. In other embodiments, the coupling element may be made from a different material to the first sealed container and the second sealed container.

The shape and dimensions of the first sealed container of the cartridge may be chosen to allow a desired amount of nicotine to be housed in the cartridge.

The shape and dimensions of the second sealed container of the cartridge may be chosen to allow a desired amount of acid to be housed in the cartridge.

The shape and dimensions of the first sealed container and the second sealed container of the cartridge may be the same or different.

Advantageously, the shape and dimensions of the first sealed container and the second sealed container are substantially the same. Providing a first sealed container and a second sealed container having substantially the same shape and dimensions may facilitate direct connection of the coupling element to both the first sealed container and the second sealed container.

Advantageously, the first sealed container and the second sealed container are substantially cylindrical. In such embodiments, advantageously the coupling element may also be substantially cylindrical. For example, the coupling element may have a hollow substantially cylindrical shape.

The cartridge may have any suitable shape.

For example, the cartridge may be substantially cylindrical.

The cartridge may have any suitable size.

For example, the cartridge may have a length of between about 5 millimetres and about 50 millimetres. Advantageously, the cartridge may have a length between about 10 millimetres and about 20 millimetres.

For example, the cartridge may have a width of between about 4 millimetres and about 10 millimetres and a height of between about 4 millimetres and about 10 millimetres. Advantageously, the cartridge may have a width of between about 6 millimetres and about 8 millimetres and a height of between about 6 millimetres and about 8 millimetres.

One or both of the first sealed container comprising the nicotine source and the second sealed container comprising the acid source may be sealed by one or more frangible barriers. For example, one or both of the first sealed container and the second sealed container of the cartridge may be sealed by one or more pierceable seals.

In such embodiments, prior to use of the cartridge in an aerosol-generating system, the one or more frangible barriers are ruptured to allow air flow through the cartridge.

The one or more frangible barriers may be formed from any suitable material. For example, the one or more frangible barriers may be formed from a metal foil or film.

One or both of the first sealed container comprising the nicotine source and the second sealed container comprising the acid source may be sealed by one or more removable barriers. For example, one or both of the first sealed container and the second sealed container of the cartridge may be sealed by one or more peel-off seals.

In such embodiments, prior to use of the cartridge in an aerosol-generating system, the one or more removable barriers are removed to allow air flow through the cartridge.

The one or more removable barriers may be formed from any suitable material. For example, the one or more removable barriers may be formed from a metal foil or film.

Advantageously, an end of the first sealed container proximate to the coupling element is sealed by a frangible barrier.

Advantageously, an end of the second sealed container proximate to the coupling element is sealed by a frangible barrier.

Advantageously, an end of the first sealed container proximal to the coupling element is sealed by a frangible barrier and an end of the second sealed container proximal to the coupling element is sealed by a frangible barrier.

Advantageously, an end of the first sealed container distal to the coupling element is sealed by a removable or frangible barrier.

Advantageously, an end of the second sealed container distal to the coupling element is sealed by a removable frangible barrier.

Advantageously, an end of the first sealed container distal to the coupling element is sealed by a removable or frangible barrier and an end of the second sealed container distal to the coupling element is sealed by a removable or frangible barrier.

Advantageously, the first sealed container of the cartridge comprises a nicotine source comprising a first carrier material impregnated with nicotine.

Prior to use of the cartridge in an aerosol-generating system, any removable and frangible barriers sealing the first sealed container and the second sealed container are removed or ruptured to allow air flow through the cartridge.

Following removal or rupture, the first container and the second container

As used herein with reference to the invention, the term "nicotine", is used to describe nicotine, nicotine base or a nicotine salt.

Advantageously, the first sealed container of the cartridge comprises a nicotine source comprising a first carrier material impregnated with between about 1 milligram and about 50 milligrams of nicotine. In embodiments in which the first carrier material is impregnated with nicotine base or a nicotine salt, the amounts of nicotine recited herein is the amount of nicotine base or amount of ionised nicotine, respectively.

The first carrier material may be impregnated with liquid nicotine or a solution of nicotine in an aqueous or non-aqueous solvent.

The first carrier material may be impregnated with natural nicotine or synthetic nicotine.

The acid source may comprise an organic acid or an inorganic acid.

Advantageously, the acid source comprises an organic acid, more advantageously a carboxylic acid, most advantageously an alpha-keto or 2-oxo acid or lactic acid.

Advantageously, the acid source comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. Advantageously, the acid source comprises pyruvic acid or lactic acid. More advantageously, the acid source comprises lactic acid.

Advantageously, the second sealed container of the cartridge contains an acid source comprising a second carrier material impregnated with acid.

The first carrier material and the second carrier material may be the same or different.

Advantageously, the first carrier material and the second carrier material have a density of between about 0.1 grams/cubic centimetre and about 0.3 grams/cubic centimetre.

Advantageously, the first carrier material and the second carrier material have a porosity of between about 15 percent and about 55 percent.

The first carrier material and the second carrier material may comprise one or more of glass, cellulose, ceramic, stainless steel, aluminium, polyethylene (PE), polypropylene, polyethylene terephthalate (PET), poly(cyclohexanedimethylene terephthalate) (PCT), polybutylene terephthalate (PBT), polytetrafluoroethylene (PTFE), expanded polytetrafluoroethylene (ePTFE), and BAREX®.

The first carrier material acts as a reservoir for the nicotine.

Advantageously, the first carrier material is chemically inert with respect to nicotine.

The first carrier material may have any suitable shape and size. For example, the first carrier material may be in the form of a sheet, plug or tube. For example, the first carrier material may be in the form of a substantially cylindrical plug or a substantially cylindrical hollow tube.

The shape, size, density and porosity of the first carrier material may be chosen to allow the first carrier material to be impregnated with a desired amount of nicotine.

Advantageously, the first sealed container of the cartridge may further comprise a flavourant. Suitable flavourants include, but are not limited to, menthol.

The second carrier material acts as a reservoir for the acid.

Advantageously, the second carrier material is chemically inert with respect to the acid.

The second carrier material may have any suitable shape and size. For example, the second carrier material may be in the form of a sheet, plug or tube. For example, the second carrier material may be in the form of a substantially cylindrical plug or a substantially cylindrical hollow tube.

The shape, size, density and porosity of the second carrier material may be chosen to allow the second carrier material to be impregnated with a desired amount of acid.

Advantageously, the second sealed container of the cartridge contains a lactic acid source comprising a second carrier material impregnated with between about 2 milligrams and about 60 milligrams of lactic acid.

The ratio of nicotine and acid required to achieve an appropriate reaction stoichiometry may be controlled and balanced through variation of the volume of the first sealed container relative to the volume of the second sealed container.

The cartridge may further comprise a susceptor for inductively heating one or both of the nicotine source and the acid source.

According to the invention there is also provided an aerosol-generating article for use in an aerosol-generating system, the aerosol-generating article comprising: a cartridge comprising a first sealed container comprising a nicotine source, a second sealed container comprising an acid source and a coupling element disposed between the first sealed container and the second sealed container, wherein the coupling element is directly connected to both the first sealed container and the second sealed container so as to form a substantially rigid connection between the first sealed container and the second sealed container; and a mouthpiece.

As used herein with reference to the invention, the terms "proximal", "distal", "upstream" and "downstream" are used to describe the relative positions of components, or portions of components, of the aerosol-generating article according to the invention.

The aerosol-generating article according to the invention comprises a proximal end through which, in use, an aerosol of nicotine salt particles exits the aerosol-generating article for delivery to a user. The proximal end may also be referred to as the mouth end. In use, a user draws on the proximal end of the aerosol-generating article in order to inhale an aerosol generated by the aerosol-generating article. The aerosol-generating article comprises a distal end opposed to the proximal end.

When a user draws on the proximal end of the aerosol-generating article, air is drawn into the aerosol-generating article, passes through the cartridge and exits the aerosol-generating article through the mouthpiece at the proximal end thereof. Components, or portions of components, of the aerosol-generating article may be described as being upstream or downstream of one another based on their relative positions between the proximal end and the distal end of the aerosol-generating article.

As used herein, the term "longitudinal" is used to describe the direction between the proximal end and the opposed distal end of the aerosol-generating article and the term "transverse" is used to describe the direction perpendicular to the longitudinal direction.

As used herein, by "length" is meant the maximum longitudinal dimension between the distal end and the proximal end of components, or portions of components, of aerosol-generating articles according to the invention.

As used herein with reference to the invention, the terms "height" and "width" are used to describe the maximum transverse dimensions of components, or portions of components, of the cartridge or aerosol-generating system perpendicular to the longitudinal direction. Where the height and width of components, or portions of components, of aerosol-generating articles according to the invention are not the same, the term "width" is used to refer to the larger of the two transverse dimensions perpendicular to the longitudinal direction.

The mouthpiece is at the proximal end of the aerosol-generating article. The cartridge is upstream of the mouthpiece.

The second sealed container may be upstream or downstream of the first sealed container. Advantageously, the second sealed container is downstream of the first sealed container.

The mouthpiece may comprise a filter. The filter may have a low particulate filtration efficiency or a very low particulate filtration efficiency.

The mouthpiece may comprise a hollow tube.

The mouthpiece may comprise one or more aerosol-modifying agents. For example, the transfer section may comprise one or more flavourants, one or more chemesthetic agents or a combination thereof.

The mouthpiece may be designed to be disposed of once the nicotine in the first sealed container and the acid in the second sealed of the cartridge are depleted. In such embodiments, the entire aerosol-generating article may be designed to be disposed of once the nicotine in the first sealed container and the acid in the second sealed are depleted.

The mouthpiece may be designed to be reusable. In such embodiments, the mouthpiece may be configured to be removably attached to the cartridge of the aerosol-generating article.

The aerosol-generating article may further comprise a transfer section disposed between the cartridge and the mouthpiece.

In such embodiments, the transfer section may comprise one or more aerosol-modifying agents. For example, the transfer section may comprise one or more flavourants, one or more chemesthetic agents or a combination thereof.

The shape and dimensions of the aerosol-generating article may simulate those of a combustible smoking article, such as a cigarette, a cigar, or a cigarillo. Advantageously, the shape and dimensions of the aerosol-generating article may simulate those of a cigarette.

According to the invention there is provided an aerosol-generating system comprising: a cartridge comprising a first sealed container comprising a nicotine source, a second sealed container comprising an acid source and a coupling element disposed between the first sealed container and the second sealed container, wherein the coupling element is directly connected to both the first sealed container and the second sealed container so as to form a substantially rigid connection between the first sealed container and the second sealed container; and a mouthpiece; and an aerosol-generating device comprising: a cavity for receiving at least a portion of the cartridge; and a heater for heating one or both of the nicotine source and the acid source of the cartridge.

According to the invention there is also provided an aerosol-generating system comprising: an aerosol-generating article comprising: a cartridge comprising a first sealed container comprising a nicotine source, a second sealed container comprising an acid source and a coupling element disposed between the first sealed container and the second sealed container, wherein the coupling element is directly connected to both the first sealed container and the second sealed container so as to form a substantially rigid connection between the first sealed container and the second sealed container; and a mouthpiece; and an aerosol-generating device comprising: a cavity for receiving at least a portion of the cartridge; and a heater for heating one or both of the nicotine source and the acid source of the cartridge.

Advantageously, the length of the cavity of the aerosol-generating device is less than the length of the aerosol-generating article so that when the aerosol-generating article is received in the cavity of the aerosol-generating device the mouthpiece of the aerosol-generating article projects from the cavity of the aerosol-generating device.

Advantageously, the aerosol-generating device is designed to be reusable.

Advantageously, the aerosol-generating device comprises a heater for heating both of the nicotine source and the acid source of the cartridge.

The heater may be arranged to circumscribe at least a portion of the cartridge when the cartridge or aerosol-generating article is received within the cavity.

The heater may be an electrical heater. The heater may be a resistive heater.

The heater may be an inductive heater and the cartridge may comprise a susceptor for inductively heating one or both the nicotine source and the acid source.

Advantageously, the heater is configured to heat the nicotine source and the acid source of the cartridge to a temperature of below about 250 degrees Celsius. More advantageously, the heater is configured to heat the nicotine source and the acid source of the cartridge to a temperature of between about 80 degrees Celsius and about 150 degrees Celsius.

Advantageously, the heater is configured to heat the nicotine source and the acid source of the cartridge to substantially the same temperature.

As used herein with reference to the invention, by "substantially the same temperature" it is meant that the difference in temperature between the nicotine source and the acid source of the cartridge measured at corresponding locations relative to the heater is less than about 3° C.

Heating one or both of the nicotine source and the acid source of the cartridge to a temperature above ambient temperature allows control of the amount of nicotine vapour and acid vapour released from the nicotine source and the acid source, respectively. This advantageously enables the vapour concentrations of the nicotine and the acid to be controlled and balanced proportionally to yield an efficient reaction stoichiometry. This advantageously improves the efficiency of the formation of an aerosol of nicotine salt particles and the consistency of delivery to a user. It also advantageously reduces the delivery of unreacted nicotine vapour and unreacted acid vapour to a user.

The aerosol-generating device may further comprise a power supply for supplying power to the heater and a controller configured to control a supply of power from the power supply to the heater.

The aerosol-generating device may further comprise one or more temperature sensors configured to sense the temperature of the heater and the temperature of one or both of the nicotine source and the acid source of the cartridge. In such embodiments, the controller may be configured to control a supply of power to the heater based on the sensed temperature.

As previously described above, one or both of the first sealed container comprising the nicotine source and the second sealed container comprising the acid source may be sealed by one or more frangible barriers. In such embodiments, the aerosol-generating device advantageously further comprises a piercing member configured to rupture the one or more frangible barriers sealing one or both of the first sealed container and the second sealed container of the cartridge.

The piercing member may be positioned centrally within the cavity of the aerosol-generating device and extend along the longitudinal axis of the cavity.

For the avoidance of doubt, features described above in relation to one aspect of the invention may also be applicable to other aspects of the invention. In particular, features described above in relation to cartridges according to the invention may also relate, where appropriate, to aerosol-generating articles and aerosol-generating systems according to the invention, and vice versa.

The invention will now be further described with reference to the accompanying drawings in which.

Figure 1:
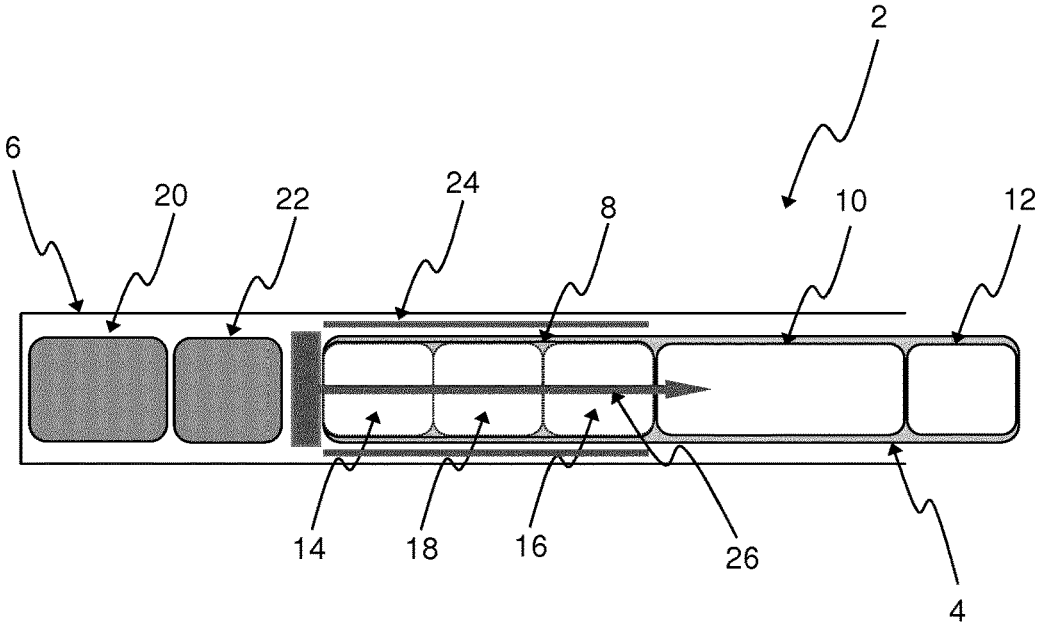
FIG. 1 shows a schematic longitudinal cross-section of an aerosol-generating system according to an embodiment of the invention comprising: an aerosol-generating article; and an aerosol-generating device.

The aerosol-generating system 2 according to the embodiment of the invention shown in FIG. 1 comprises an aerosol-generating article 4 and an aerosol-generating device 6.

In the embodiment shown, the aerosol-generating article 4 is configured as a one-piece consumable that is discarded after use and has an elongate cylindrical shape. The aerosol-generating article 4 comprises a cartridge 8, a transfer section 10 and a mouthpiece 12. The cartridge 8, the transfer section 10 and the mouthpiece 12 are arranged in series and in coaxial alignment within the aerosol-generating article 4. The cartridge 8 is located at the distal end of the aerosol-generating article 4. The transfer section 10 is located immediately downstream of the cartridge 8. The mouthpiece 12 is located immediately downstream of the transfer section 10 at the proximal end of the aerosol-generating article 4. The cartridge 8, the transfer section 10 and the mouthpiece 12 are circumscribed by an outer wrapper (not shown) of paper of other wrapping material.

The cartridge 8 comprises a first container 14 comprising a nicotine source (not shown), a second container 16 comprising an acid source (not shown) and a coupling element 18. The coupling element 18 is disposed between the first container 14 and the second container 16. The coupling element 18 is directly connected to both the first container 14 and the second container 16 so as to form a substantially rigid connection between the first container 14 and the second container 16.

In the embodiment shown, the nicotine source in the first container 14 of the cartridge 8 comprises a first carrier material impregnated with nicotine. The acid source in the second container 16 of the cartridge 8 comprises a second carrier material impregnated with lactic acid.

The aerosol-generating device 8 comprises an elongate cylindrical cavity configured to receive the aerosol-generating article 4. As shown in FIG. 1, the length of the cavity is less than the length of the aerosol-generating article 4 so that when the distal end of the aerosol-generating article 4 is inserted into the cavity of the aerosol-generating device 6, the mouthpiece 10 at the proximal end of the aerosol-generating article 4 protrudes from the cavity of the aerosol-generating device 6.

The aerosol-generating device 6 further comprises a power supply 20, control circuitry 22, and a heater 24. The control circuitry 22 is configured to control the supply of power from the power supply 20 to the heater 24. In the embodiment shown, the power supply 20 is a battery and the heater 24 is an electrical heater. As shown in FIG. 1, the heater is positioned about the perimeter of an upstream portion of the cavity and extends around the circumference of the cavity such that it circumscribes the first container 14, the second container 16 and the coupling element 18 of the cartridge 8 of the aerosol-generating article 4.

Prior to insertion of the distal end of the aerosol-generating article 4 into the cavity of the aerosol-generating device 6, the distal and proximal ends of the first container 14 of the cartridge 8 are sealed by a pair of opposed frangible barriers 19 and the distal and proximal ends of the second container 16 of the cartridge 8 are sealed by a pair of opposed frangible barriers 19. In the embodiment shown, the frangible barriers 19 sealing the proximal and distal ends of the first container 14 and the second container 16 of the cartridge 8 are made from aluminium film.

The aerosol-generating device 6 also further comprises a piercing member 26. The piercing member 26 is positioned centrally within the cavity of the aerosol-generating device 6 and extends along the longitudinal axis of the cavity. The piercing member comprises a shaft portion and a piercing portion at the free end of the shaft portion.

In use, as the distal end of the aerosol-generating article 6 is inserted into the cavity of the aerosol-generating device 6, the piercing member 26 of the aerosol-generating device 6 is inserted into the aerosol-generating article 6. The piercing portion of the piercing member ruptures the pair of opposed frangible barriers sealing the distal and proximal ends of the first container 14 of the cartridge 8 and the pair of opposed frangible barriers sealing the distal and proximal ends of the second container 16 of the cartridge 8. This creates an airflow pathway extending through the aerosol-generating article 4 from the distal end of the aerosol-generating article 4, downstream through the first container 14, the coupling element 18 and the second container 16 of the cartridge 8 and the transfer section 10, to the mouthpiece 12 at the proximal end of the aerosol-generating article 4.

Once the aerosol-generating article 6 is inserted into the cavity of the aerosol-generating device 4, the heater 26 of the aerosol-generating device 6 heats the first container 14 and the second container 16 of the cartridge 8 of the aerosol-generating article 4 and the user draws on the mouthpiece 12 at the proximal end of the aerosol-generating article 4 to draw air through the aerosol-generating article 4 along the airflow pathway.

As the user draws air through the aerosol-generating article 4 along the airflow pathway, nicotine vapour from the nicotine source is released into the drawn air as it passes through the first container 14 of the cartridge 8 and lactic acid vapour from the acid source is released into the drawn air as it passes through the second container 16 of the cartridge 8. The nicotine vapour reacts with the lactic acid vapour in the gas phase in the second container 16 of the cartridge 8 and the transfer section 10 of the aerosol-generating article 4 to form an aerosol of nicotine lactate salt particles, which is delivered to the user through the mouthpiece 12 at the proximal end of the aerosol-generating article 4.

Figure 2:
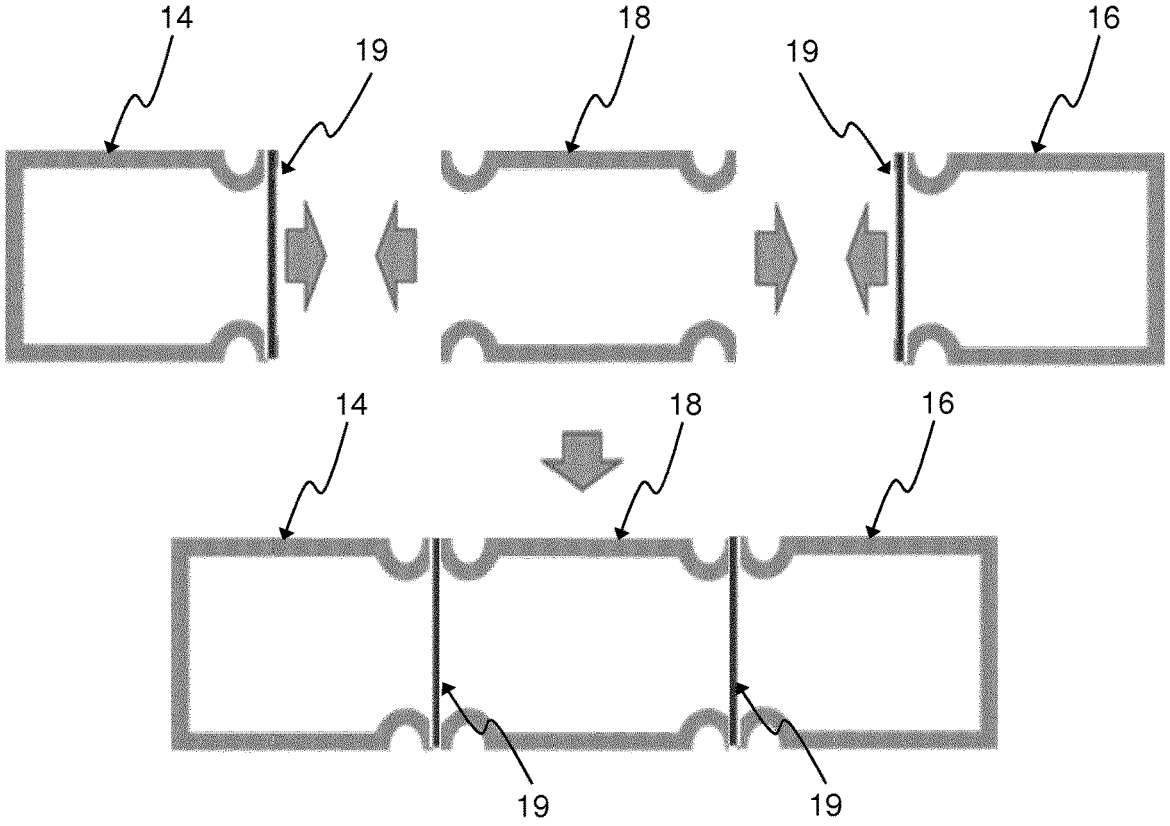
FIG. 2 shows a cartridge according to a first embodiment of the invention for use in the aerosol-generating system of FIG. 1.

FIG. 2 shows a cartridge according to a first embodiment of the invention for use in the aerosol-generating system 2 shown in FIG. 1. In this embodiment, the coupling element 18 of the cartridge 8 is made from aluminium and has a hollow substantially cylindrical shape.

As shown in FIG. 2, the coupling element 18 is directly connected to the first container 14 comprising the nicotine source by welding a first end of the coupling element 18 to one of the pair of opposed frangible barriers 19 made from aluminium film that seal the ends of the first container 14. The coupling element 18 is directly connected to the second container 16 comprising the acid source by welding a second end of the coupling element 18 to one of the pair of opposed frangible barriers 19 made from aluminium film that seal the ends of the second container 16. The coupling element 18 forms a substantially rigid connection between the first sealed container 14 and the second sealed container 16. The coupling element 18 holds the first sealed container 14 and the second sealed container 16 in a substantially fixed position relative to one another within the cartridge.

Figure 3:
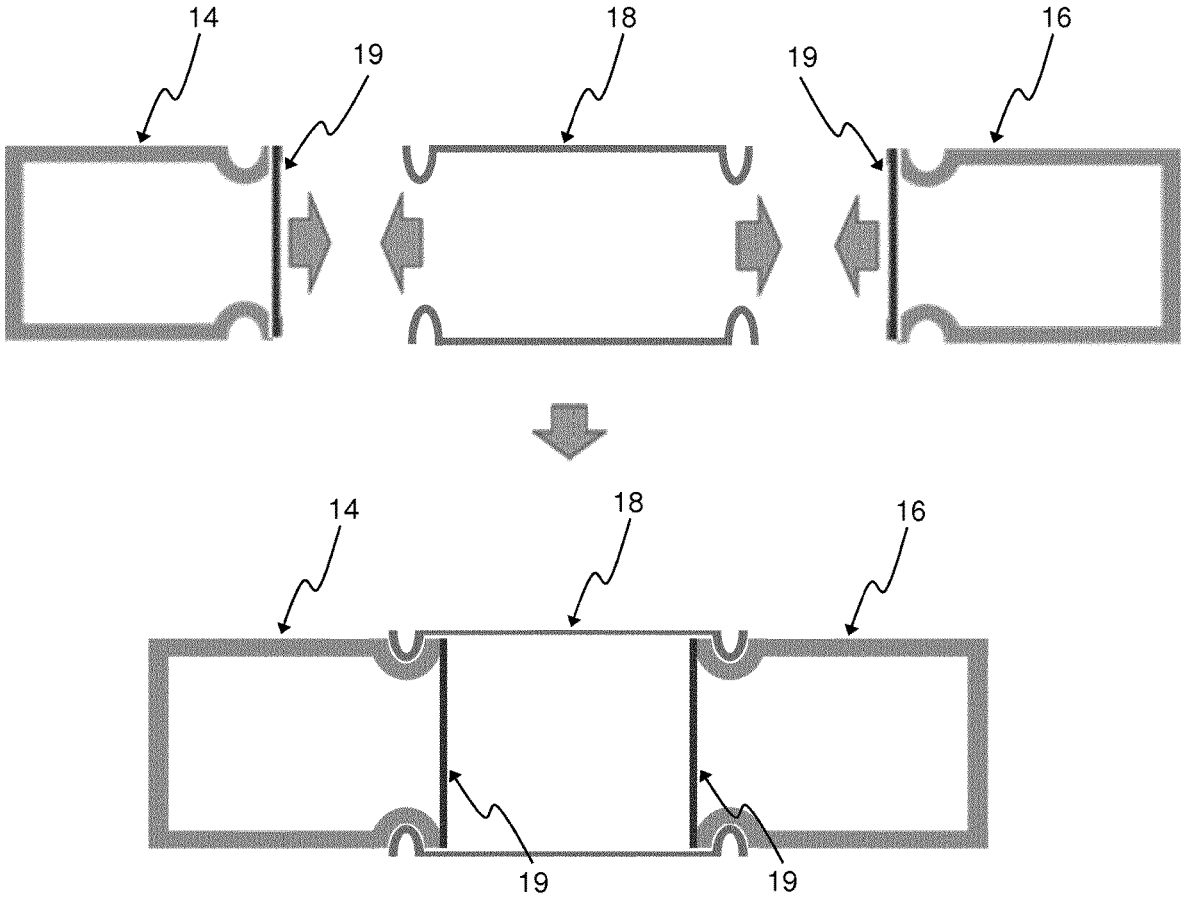
FIG. 3 shows a cartridge according to a second embodiment of the invention for use in the aerosol-generating system of FIG. 1.

FIG. 3 shows a cartridge according to a second embodiment of the invention for use in the aerosol-generating system 2 shown in FIG. 1. In this embodiment, the coupling element 18 of the cartridge 8 is formed from an elastically deformable resilient material and has a hollow substantially cylindrical shape.

As shown in FIG. 3, a first end of the coupling element 18 is directly connected to an end of the first sealed container 14 comprising the nicotine source by a snap-fit connection and a second end of the coupling element 18 is directly connected to an end of the second sealed container 16 by a snap-fit connection. The coupling element 18 forms a substantially rigid connection between the first sealed container 14 and the second sealed container 16. The coupling element 18 holds the first sealed container 14 and the second sealed container 16 in a substantially fixed position relative to one another within the cartridge.

The invention claimed is:

1. A cartridge for an aerosol-generating system, the cartridge comprising:

a first sealed container comprising a nicotine source;

a second sealed container comprising an acid source; and a coupling element disposed between the first sealed container and the second sealed container, wherein the first sealed container, the second sealed container, and the coupling element are physically separate components in a first position prior to being connected together, and are connected together in a second position different from the first position to form the cartridge, wherein the coupling element is directly connected to both the first sealed container and the second sealed container so as to form a substantially rigid connection between the first sealed container and the second sealed container, wherein the coupling element is directly connected to the first sealed container at a first end of the coupling element and the coupling element is directly connected to the second sealed container at a second end of the coupling element, the second end being opposite to the first end of the coupling element, and wherein the coupling element is connected to both the first sealed container and the second sealed container by welds, or by a snap-fit connection, or by a threaded connection.

2. The cartridge according to claim 1, wherein an end of the first sealed container proximate to the coupling element is sealed by a frangible barrier.

3. The cartridge according to claim 1, wherein an end of the second sealed container proximate to the coupling element is sealed by a frangible barrier.

4. The cartridge according to claim 1, wherein an end of the first sealed container distal to the coupling element is sealed by a removable or frangible barrier and an end of the second sealed container distal to the coupling element is sealed by a removable or frangible barrier.

5. The cartridge according to claim 1, further comprising a wrapper circumscribing each of the coupling element, the first sealed container, and the second sealed container.

6. The cartridge according to claim 1, wherein the acid source comprises a second carrier material impregnated with lactic acid.

7. An aerosol-generating article for an aerosol-generating system, the aerosol-generating article comprising:

the cartridge according to claim 1; and a mouthpiece.

8. The aerosol-generating article according to claim 7, wherein the second sealed container is downstream of the first sealed container.

9. An aerosol-generating system, comprising:

the cartridge according to claim 1; and an aerosol-generating device comprising:

a cavity configured to receive at least a portion of the cartridge, and a heater configured to heat one or both of the nicotine source and the acid source of the cartridge.

10. The aerosol-generating system according to claim 9, wherein the heater is further configured to heat both of the nicotine source and the acid source of the cartridge.

11. The aerosol-generating system according to claim 10, wherein the aerosol-generating device further comprises a piercing member configured to rupture one or more frangible barriers sealing one or both of the first sealed container and the second sealed container of the cartridge.

12. An aerosol-generating system, comprising:

an aerosol-generating article comprising:

the cartridge according to claim 1, and a mouthpiece; and an aerosol-generating device comprising:

a cavity configured to receive at least a portion of the aerosol-generating article, and a heater configured to heat one or both of the nicotine source and the acid source of the cartridge.

13. The aerosol-generating system according to claim 12, wherein the heater is further configured to heat both of the nicotine source and the acid source of the cartridge.

14. The aerosol-generating system according to claim 13, wherein the aerosol-generating device further comprises a piercing member configured to rupture one or more frangible barriers sealing one or both of the first sealed container and the second sealed container of the cartridge.

15. A method of manufacturing the cartridge according to claim 1 for an aerosol-generating system, the method comprising:

providing the first sealed container comprising the nicotine source comprising a first carrier material impregnated with between about 1 milligram and about 50 milligrams of nicotine;

providing the second sealed container comprising the acid source;

providing the coupling element disposed between the first sealed container and the second sealed container, wherein the first sealed container, the second sealed container, and the coupling element are separate components that are connected to one another to form the cartridge; and directly connecting the coupling element to both the first container and the second container so as to form a substantially rigid connection between the first sealed container and the second sealed container.

* * * * *